US006703785B2

(12) United States Patent
Aiki et al.

(10) Patent No.: US 6,703,785 B2
(45) Date of Patent: Mar. 9, 2004

(54) NEGATIVE ION GENERATOR

(75) Inventors: Yoshiaki Aiki, Tokyo (JP); Wakao Sakamoto, Aomori (JP)

(73) Assignee: Andes Electric Co., Ltd., Aomori Prefecture (JP)

( * ) Notice: Subject to any disclaimer, the term of this patent is extended or adjusted under 35 U.S.C. 154(b) by 0 days.

(21) Appl. No.: 10/173,882

(22) Filed: Jun. 19, 2002

(65) Prior Publication Data

US 2003/0001479 A1 Jan. 2, 2003

(30) Foreign Application Priority Data

Jun. 27, 2001 (JP) ..... 2001-194417

(51) Int. Cl.[7] ..... H05B 37/00
(52) U.S. Cl. ..... 315/111.81; 310/318
(58) Field of Search ..... 313/325; 315/363, 315/111.81, 111.91, 209 PZ; 310/318

(56) References Cited

U.S. PATENT DOCUMENTS 5,923,542 A * 7/1999 Sasaki et al. ..... 363/16

FOREIGN PATENT DOCUMENTS

| | | | |
|---|---|---|---|
| JP | 10-199654 | * | 7/1998 |
| JP | 11-299254 | * | 10/1999 |
| JP | 2001-85189 | * | 3/2001 |
| JP | 2001-102195 | * | 4/2001 |

* cited by examiner

*Primary Examiner*—David Vu
(74) *Attorney, Agent, or Firm*—Wenderoth, Lind & Ponack, L.L.P.

(57) ABSTRACT

A negative ion generator, which can suppress positive ion generation, permits ready control of a quantity of generated negative ions and permits a size and thickness reduction. The negative ion generator is of an electron emission type in which, for negative ion generation, electrons are emitted into the air by impressing a negative high voltage on a stylus electric discharge electrode. A piezoelectric transformer is used for amplifying a non-rectified drive voltage from a transformer drive circuit. As a result of rectification of the AC high voltage from the piezoelectric transformer, a negative high voltage is obtained, which is impressed on the stylus electric discharge electrode for electron emission therefrom, thereby generating negative ions in the air.

5 Claims, 2 Drawing Sheets

NEGATIVE ION GENERATOR

BACKGROUND OF THE INVENTION

1. Field of the Invention

This invention relates to negative ion generators for adequately generating negative ions by negatively charging gas molecules, such as oxygen molecules or fine particles in air.

2. Prior Art

Recently, negative ions are attracting attention in that they can provide a good influence on the living body, such as a healthy effect of preventing oxidization of the human body, an effect of holding the freshness of foodstuff and a deodorizing effect. Various types of negative ion generators are thus present, which can generate negative ions by negatively charging gas molecules, such as oxygen molecules and fine particles in air. A high voltage generation circuit in such a negative ion generator uses a ferrite high voltage transformer, which has a coil wound on an iron core, and performs electromagnetic coupling amplification by electromagnetic induction.

However, the high voltage transformer of coil type in the prior art negative ion generator generates an electromagnetic wave when performing the electromagnetic coupling amplification, and this electromagnetic wave is a cause of generating positive ions, which have adverse effects, such as oxidizing effects, on the living body. In other words, the prior art negative ion generator has a contradiction that despite it generates negative ions, it also generates a considerable number of positive ions, which cancel negative ions and have adverse effects, such as oxidizing the living body. In addition, limitations are imposed on the size and thickness reduction of the coil type high voltage transformer because of such reasons as the necessity of ensuring breakdown voltage. Therefore, it has been impossible to meet market demands for size and thickness reduction of the negative ion generator for the mounting thereof in various apparatuses. Furthermore, in order that the quantity of generated negative ions is variable, a voltage varying circuit for varying the drive voltage inputted to the transformer is necessary, and the number of circuit components is inevitably increased.

SUMMARY OF THE INVENTION

The invention, accordingly, has an object of providing a negative ion generator, which can suppress the generation of positive ions, permits ready control of the quantity of generated negative ions and permits size and thickness reduction. To attain this object, an electron emission type negative ion generator is provided which emits electrons into air when a negative high voltage is impressed on stylus electric discharge electrode. This negative ion generator uses a piezoelectric transformer for amplifying a non-rectified drive voltage from a transformer drive circuit. An AC high voltage from the piezoelectric transformer is rectified to obtain a negative high voltage, which is impressed on the stylus electric discharge electrode for electron emission wherefrom, thereby generating negative ions in air.

DETAILED DESCRIPTION OF THE PREFERRED EMBODIMENTS

Figure 1:
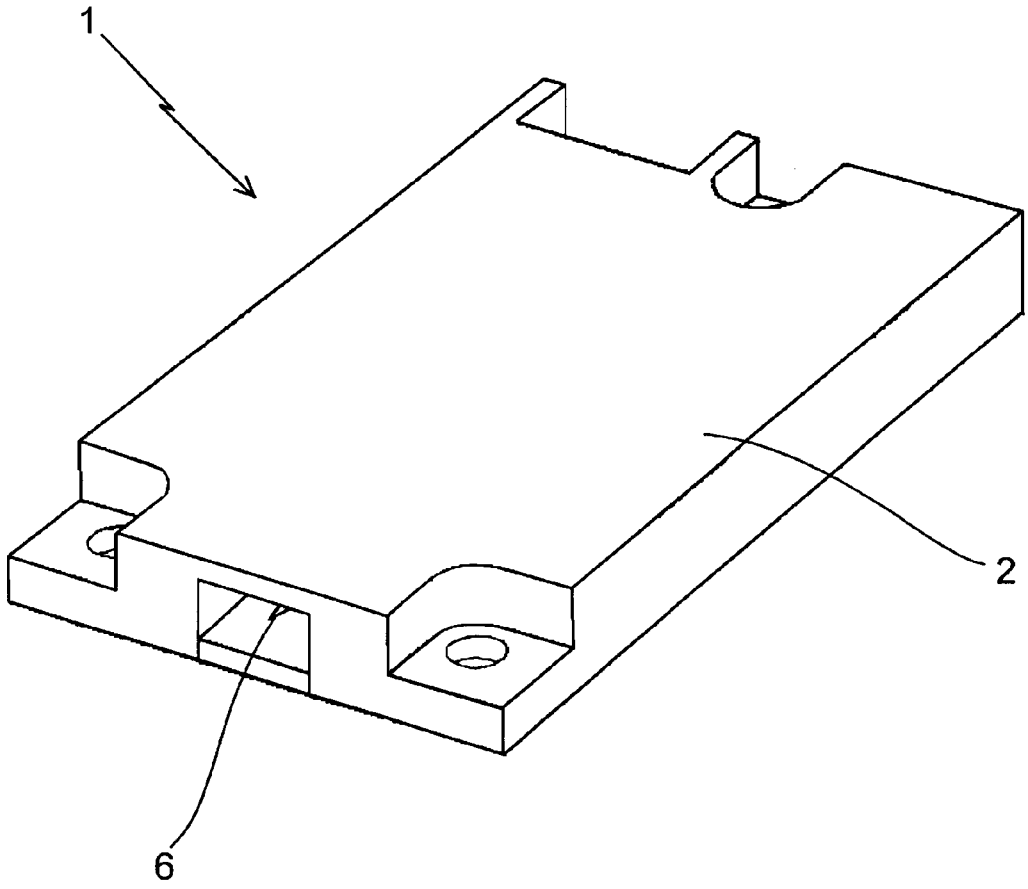
FIG. 1 is a perspective view showing a negative ion generator according to the invention.
Figure 2:
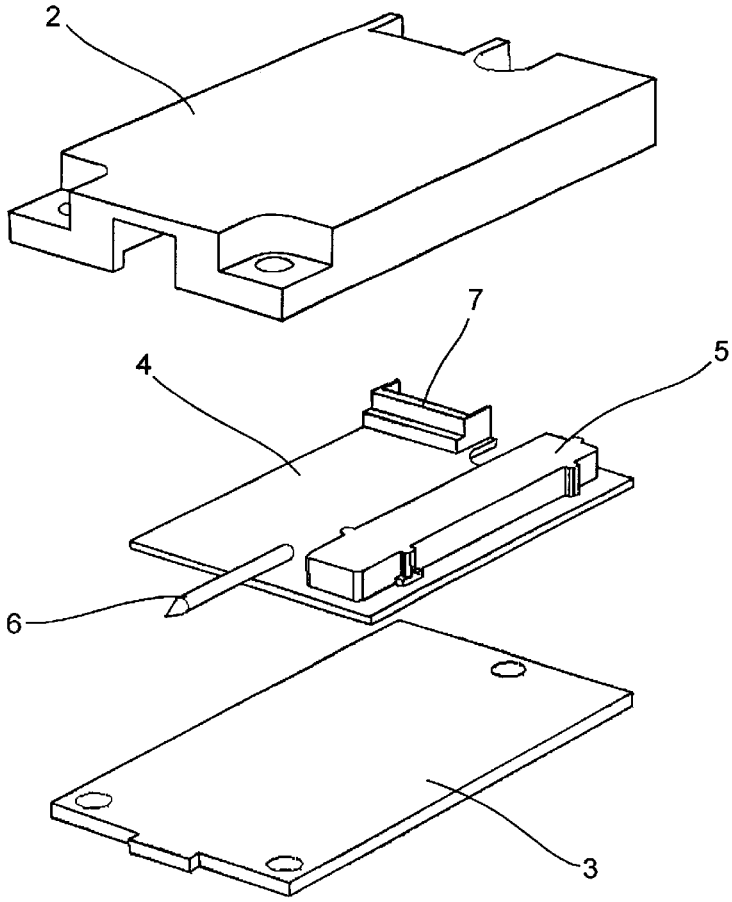
FIG. 2 is an exploded perspective view showing the negative ion generator according to the invention.

FIGS. 1 and 2 show the construction of a negative ion generator according to the invention. The illustrated negative ion generator 1 is a module comprising a thin and small casing with dimensions of 44×77×6 mm, a base member 4 accommodated in a casing 3, a piezoelectric transformer 5, a stylus electric discharge electrode 6, a drive circuit (not shown) and an input/output terminal 7 which is connected to a power supply and also to external circuitry. This negative ion generator 1 can be assembled as a negative ion generator module in various apparatus and facilities, such as air cleaners and foodstuff stock warehouses.

Figure 3:
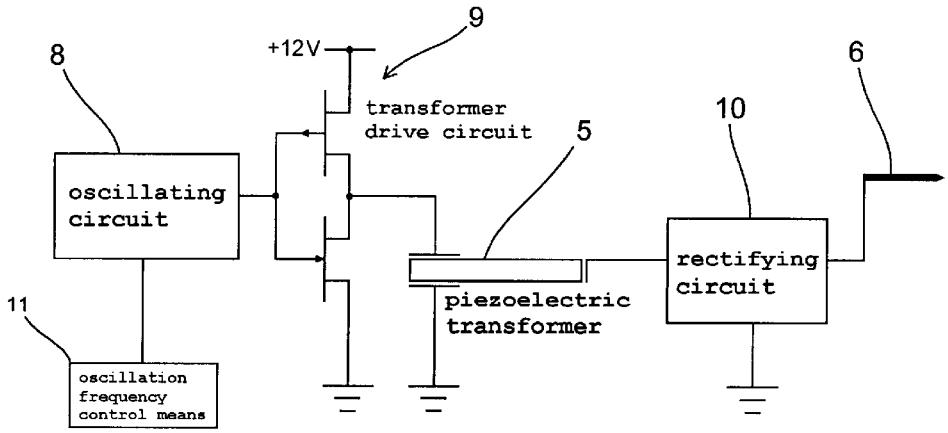
FIG. 3 is a schematic circuitry diagram of the negative ion generator according to the invention.

FIG. 3 is a circuit diagram showing the negative ion generator 1. The negative ion generator 1 has an oscillating circuit 8 using a compact timer IC as oscillating means. The oscillating circuit 8 generates a signal at a frequency of, for instance, 75 kHz as resonant frequency of the piezoelectric transformer 5 (which is determined by the length direction dimension) or the neighborhood (±5 kHz) of the resonant frequency. This signal is inputted to a transformer drive circuit 9, which is constituted by a field-effect transistor, and in turn, outputs an AC voltage for driving the piezoelectric transformer 5.

The piezoelectric transformer 5 is a small, thin and highly efficient transformer. As an example, the piezoelectric transformer 5 has a structure comprising a thin and elongate rectangular piezoelectric ceramic body, input electrodes formed on opposite side surfaces of a length direction one half of the ceramic body and output electrodes formed on the end surfaces of the ceramics body opposite the input electrodes. When an AC voltage in the neighborhood of the resonant frequency of the transformer drive circuit 9 is impressed on the input electrodes, the piezoelectric ceramic body undergoes mechanical oscillations due to the inverse piezoelectric effect, and due to the piezoelectric effect, the mechanical oscillations appear as high voltage at the output electrodes. This high voltage is outputted.

A rectifying circuit 10 rectifies the high voltage output from the output electrodes of the piezoelectric transformer 5 to a negative high voltage of −1.0 to −6.0 kV. This negative high voltage is impressed on the stylus electric discharge electrode 6, which emits electrons from its tip. In this way, negative ions are generated. The quantity of generated negative ions can be set as desired in a range of 1,000 to 2,000,000 ions/cc.

An oscillation frequency control means 11 controls the quantity of generated negative ions. Specifically, the oscillation frequency control means 11 is a variable resistor (of 105 kΩ±5 kΩ, for instance), which is provided at an oscillation frequency control terminal of the timer IC in the oscillating circuit 8. By varying the resistance of the variable resistor, the frequency of the signal outputted from the timer IC in the oscillating circuit 8 can be varied in a range of 75 kHz±5 kHz. By varying the AC voltage for driving the piezoelectric transformer 5 in a range of 75 kHz±5 kHz, the high voltage output of the piezoelectric transformer 5 can be varied greatly according to the deviation from the resonant frequency. In this way, the quantity of generated negative ions can be greatly varied in the range of 1,000 to 2,000,000 ions/cc.

In the above embodiment, the timer IC used the oscillation frequency control means 11 for varying the negative high voltage, which is impressed on the stylus electric discharge electrode 6. However, this is by no means limitative. For instance, it is possible to adopt pulse width control as another control method in the timer IC, that is, a variable resistor may be provided at a pulse width control terminal of the timer IC for varying the pulse width of the output signal, thereby varying the magnitude of the AC voltage inputted to the piezoelectric transformer.

As has been described in the foregoing, the negative ion generator according to the invention, which is an electron emission type negative ion generator for generating negative ions by the emission of electrons from the stylus electric discharge electrode into the air with a negative high voltage applied to the electric discharge electrode, uses the piezoelectric transformer as a means for outputting a non-rectified AC high voltage for generating the negative high voltage. Thus, it is possible to suppress and eliminate adverse effects of positive ion generation in the coil type transformer used for the prior art negative ion generator, and also realize a size and thickness reduction of the apparatus.

In addition, for driving the piezoelectric transformer, the timer IC is used as an oscillating means for generating an AC voltage in the neighborhood of the resonant frequency of the piezoelectric transformer. Thus, the oscillating means can be constructed with a small number of components and be reduced in size, thus contributing to the size and thickness reduction of the negative ion generator.

Furthermore, the timer IC is provided with the oscillation frequency adjusting means for adjusting the frequency. The oscillation frequency adjusting means causes variation of the frequency of the AC voltage impressed on the piezoelectric transformer for the driving thereof, that is, causes frequency deviation from the resonant frequency of the piezoelectric transformer, thus varying the negative high voltage impressed on the stylus electric discharge electrode. Thus, unlike the prior art, no large-scale voltage varying circuit is necessary, and deviation of the frequency of the AC voltage for driving the piezoelectric transformer from the resonant frequency thereof is caused by using the sole variable resistor, thereby permitting great variation of the output voltage from the piezoelectric transformer. It is, thus, possible to make the voltage varying circuit compact for reducing the size and thickness of the negative ion generator.

What is claimed is:

1. A negative ion generator for generating negative ions by electron emission into air, said negative ion generator comprising:

a piezoelectric transformer operable to output a non-rectified AC high voltage;

a rectifying circuit operable to generate a negative high voltage from the non-rectified AC high voltage from said piezoelectric transformer;

a discharge electrode connected to said rectifying circuit and adapted to emit electrons;

an oscillating circuit operable to generate a signal having a frequency in a neighborhood of a resonant frequency of said piezoelectric transformer for controlling a frequency of an AC voltage to drive said piezoelectric transformer; and an oscillation frequency controller operable to deviate the frequency of the signal of said oscillating circuit applied to said piezoelectric transformer from the resonant frequency of said piezoelectric transformer such that the negative high voltage applied to said discharge electrode is varied.

2. A negative ion generator as recited in claim 1, wherein said oscillation circuit comprises a timer IC.

3. A negative ion generator as recited in claim 1, wherein said oscillation frequency controller comprises a variable resistor.

4. A negative ion generator as recited in claim 1, wherein said discharge electrode is a stylus electric discharge electrode.

5. A negative ion generator as recited in claim 1, further comprising a transformer drive circuit connected between said oscillating circuit and said piezoelectric transformer, said transformer drive circuit being operable to supply the AC voltage to drive said piezoelectric transformer.

* * * * *